United States Patent [19]

Dix et al.

[11] 4,004,490

[45] Jan. 25, 1977

[54] STRUCTURE FOR ARTICLE HANDLING SYSTEMS

[75] Inventors: Joseph Dix, Williston; Norman Campbell; Ivar Scott Tonseth, Jr., both of Burlington, all of Vt.

[73] Assignee: General Electric Company, Burlington, Vt.

[22] Filed: Dec. 23, 1974

[21] Appl. No.: 535,834

Related U.S. Application Data

[63] Continuation of Ser. No. 352,007, April 17, 1973, abandoned.

[52] U.S. Cl. ..... 89/33 D; 89/34; 198/657

[51] Int. Cl.[2] ..... F41D 9/06

[58] Field of Search ..... 29/157.3 AH; 89/33 D, 89/34; 115/20; 180/3 A, 7 A; 198/DIG. 14, 104, 213; 301/64 SD

[56] References Cited

UNITED STATES PATENTS

| | | | |
|---|---|---|---|
| 1,156,676 | 10/1915 | Ferriss | 301/64 SD |
| 1,243,612 | 10/1917 | Krohn | 180/3 A |
| 1,445,405 | 2/1923 | Mathias | 301/64 SD |
| 1,840,317 | 1/1932 | Horvath | 29/157.3 AH |
| 3,224,407 | 12/1965 | Bertrand | 180/7 A |
| 3,696,704 | 10/1972 | Backus et al. | 89/34 |

FOREIGN PATENTS OR APPLICATIONS

| | | | |
|---|---|---|---|
| 86,619 | 7/1921 | Germany | 180/3 A |

OTHER PUBLICATIONS

Wei-Wen Yu, Design of Light Gage Cold-Formed Steel Structures, 1965, West Virginia University.

*Primary Examiner*—Stephen C. Bentley
*Attorney, Agent, or Firm*—Bailin L. Kuch

[57] ABSTRACT

An ammunition handling system is disclosed having a helical fin of substantially folded plate cross-section made from continuous rectangular ribbons of stock material.

16 Claims, 9 Drawing Figures

10
12
14
16
18
20
22
24
26
28
30
32
66
66

PRIOR ART

Fig. 4.
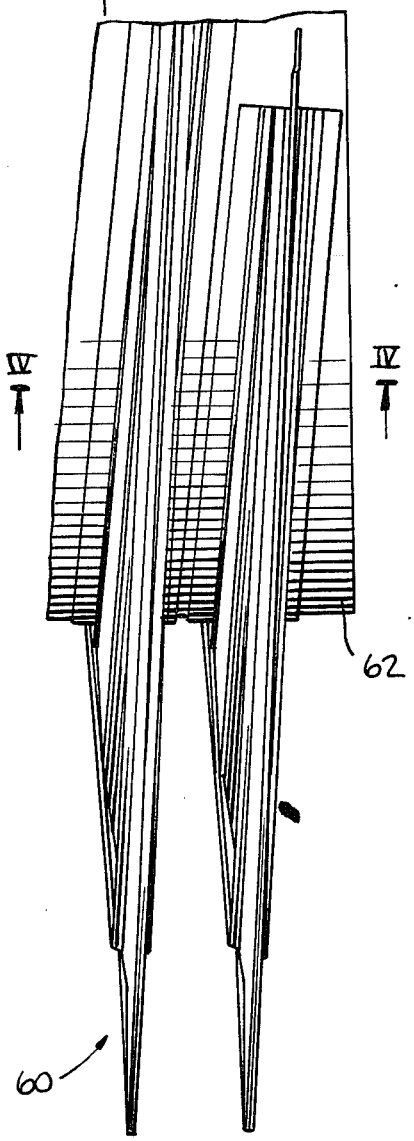
Fig. 5.
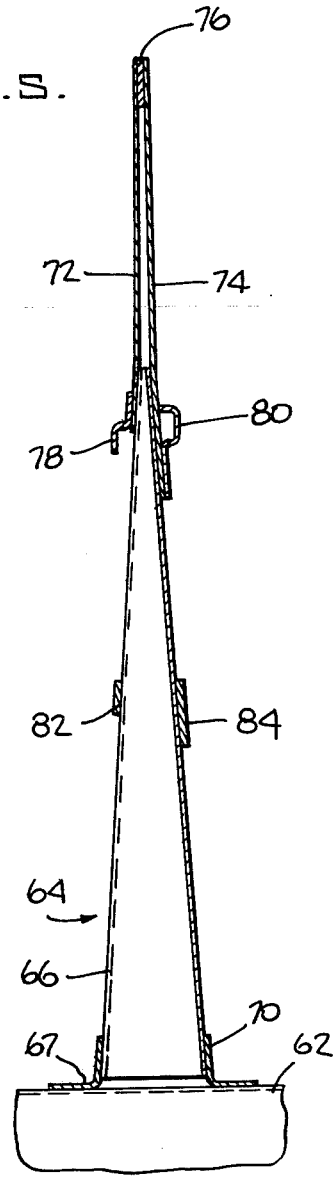
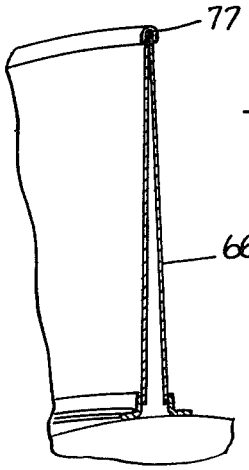
Fig. 9.

STRUCTURE FOR ARTICLE HANDLING SYSTEMS

This application is a continuation of Ser. No. 352,007, filed Apr. 17, 1973, now abandoned.

BACKGROUND OF THE INVENTION

1. Field of the Invention

This invention relates to the construction of helixes and augers for article handling systems, particularly the helixes of linkless, drum type ammunition storage systems.

The invention herein described was made in the course of or under a contract or subcontract thereunder with the Department of Defense.

2. Prior Art

Linkless, drum type ammunition storage systems are well known, and are shown, for example, in U.S. Pat. No. 3,696,704 issued to L. F. Backus et al. on Oct. 12, 1972, and other patents and publications cited therein. Conventionally, such systems comprise a central helix or auger rotating about a central axis within an outer drum having a plurality of centripetally directed, longitudinally extending guides disposed in an annular row. Rounds of ammunition are stored in longitudinally extending columns with their bases respectively between guides, and their tips respectively between turns of the helix. As the helix rotates, it advances the rounds longitudinally.

The conventional helix is substantially a hollow core-tube with a single or double lead helical fin of isosceles triangular cross-section wound around and fixed thereto. This helical fin is made conventionally of a plurality of annular disks each having a radial slit therein. The disks are distorted longitudinally at the slit by a one or two pitch distance and by back-to-back pairs are welded together and to the tube to form a single turn of helical fin of triangular cross-section, and to the immediately preceding and succeeding pairs to form a multi-turn helix.

There are several disadvantages to this conventional construction:

1. Wasted scrap. The annular disks are stamped out of squares of metal. The inner circle and the outer corners are wasted.

2. Weight. Each turn of the helical fin is stressed from one side as the helix is rotated against the rounds of ammunition. The disk on the stressed side is put into tension, while the disk on the lee side is put into compression. The primary failure mode of this structure is buckling of the lee side disk in compression, with failure in tension of the spot-welds or other fasteners between the core-tube and the stressed side disk. Therefore, the disks must be made thick enough to resist such failure.

3. Alignment. Each of the disks must be accurately aligned with and secured to the mating disk, the preceding and succeeding disk and the core tube.

Accordingly, it is an object of this invention to provide a helical fin of triangular cross-section which requires no scrap to produce, is of minimum weight, and which requires no alignment of disks.

A feature of this invention is the provision of a helix having a helical fin of substantially folded plate cross-section made of integrally continuous ribbons of material.

Another feature of this invention is the provision of a process of manufacturing a helix having a helical fin of substantially folded plate cross-section from continuous rectangular ribbons of stock material.

BRIEF DESCRIPTION OF THE DRAWING

These and other objects, features, and advantages of this invention will be apparent from the following specification thereof taken in conjunction with the accompanying drawing in which:

FIG. 4 is a detail of a central helix embodying this invention;

FIG. 5 is a longitudinal cross-section of a helical fin taken along plane V—V of FIG. 4;

FIG. 9 is a detail of a perspective view of another helix embodying this invention.

THE ARTICLE HANDLING SYSTEM

Figures 1, 7, 8:
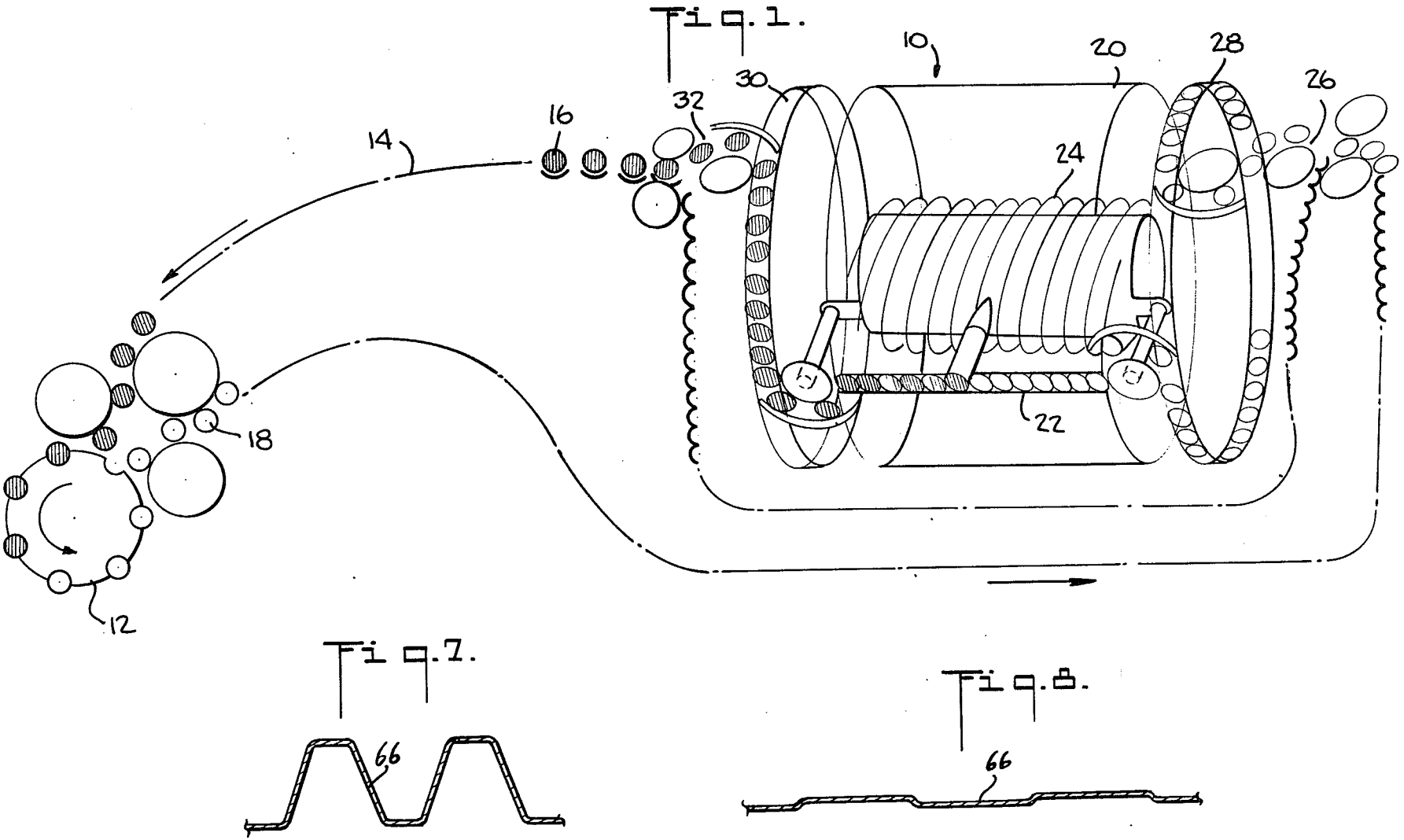
FIG. 1 is a schematic diagram of a linkless, drum type ammunition storage system having a central helix.
FIG. 7 is a transverse cross-section of the fin taken along plane VII—VII of FIG. 6.
FIG. 8 is a transverse cross-section of the fin taken along plane VIII—VIII of FIG. 6.

The article handling system is illustrated in FIG. 1 as a linkless, drum type ammunition storage system 10 coupled to a Gatling type gun 12 by an ammunition conveyor system 14. The conveyor system receives rounds 16 from the storage system and delivers them to the gun; and receives empty cases 18 from the gun and delivers them to the storage system. The storage system includes an outer drum 20 having a plurality of longitudinally extending, centripetally directed partitions 22, an inner helix 24, a rounds entrance unit 26, an input scoop disk assembly 28, an output scoop disk assembly 30, and a rounds exit unit 32.

Figure 2:
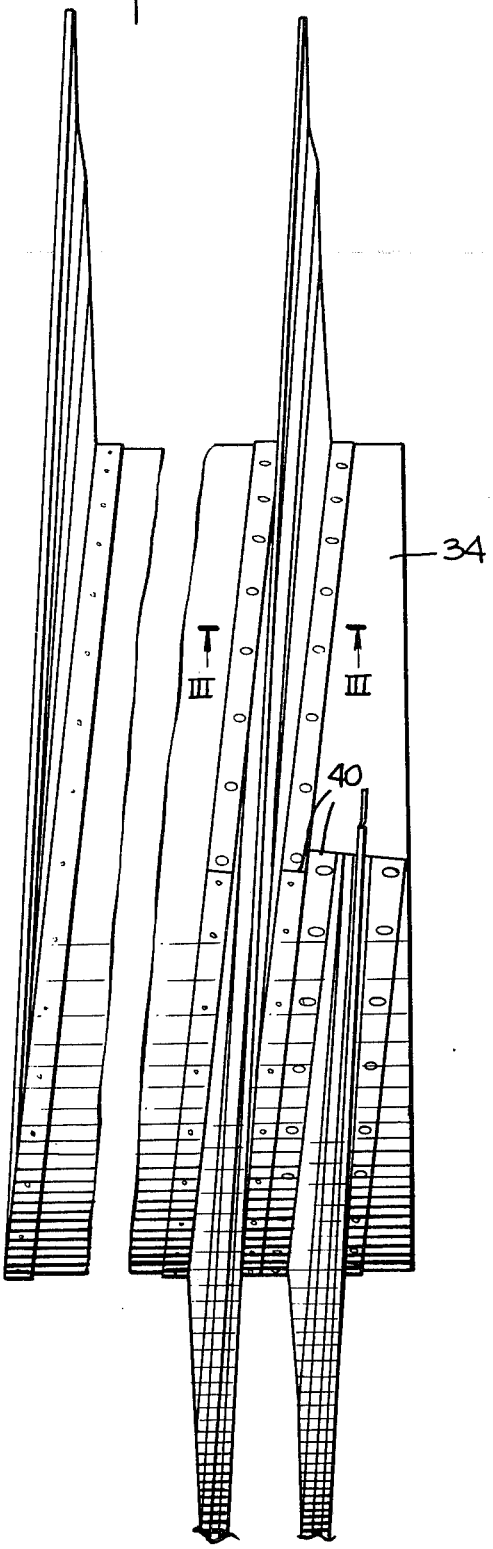
FIG. 2 is a detail of a central helix of conventional construction.
Figure 3:
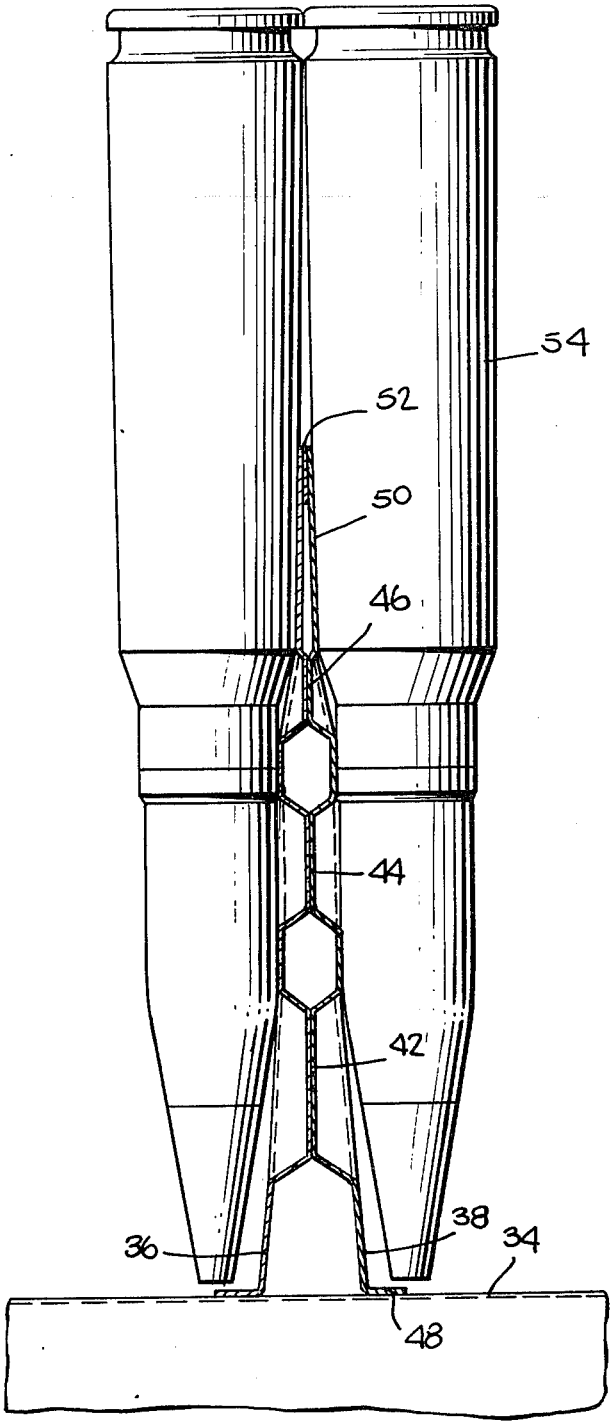
PRIOR ART Fig 3.
FIG. 3 is a longitudinal cross-section of a conventional helical fin taken along plane III—III of FIG. 2.

The conventional helix 24, as shown in FIGS. 2 and 3, is made up of a tube 34 to which are welded a plurality of back-to-back pairs of disks 26, 38. Each disk has a radial slit 40, along which the disk is distorted longitudinally by one pitch distance. Each disk has three cup like depressions 42, 44, 46 for abutment to and fastening to the mating disk; a flange 48 for abutment to and fastening to the tube 34; and a distal web 50 for abutment to and fastening to a thickness-make-up strip 52. A round 54 of ammunition is supported between the turns of the helix as shown.

THE FIRST EMBODIMENT

Figure 6:
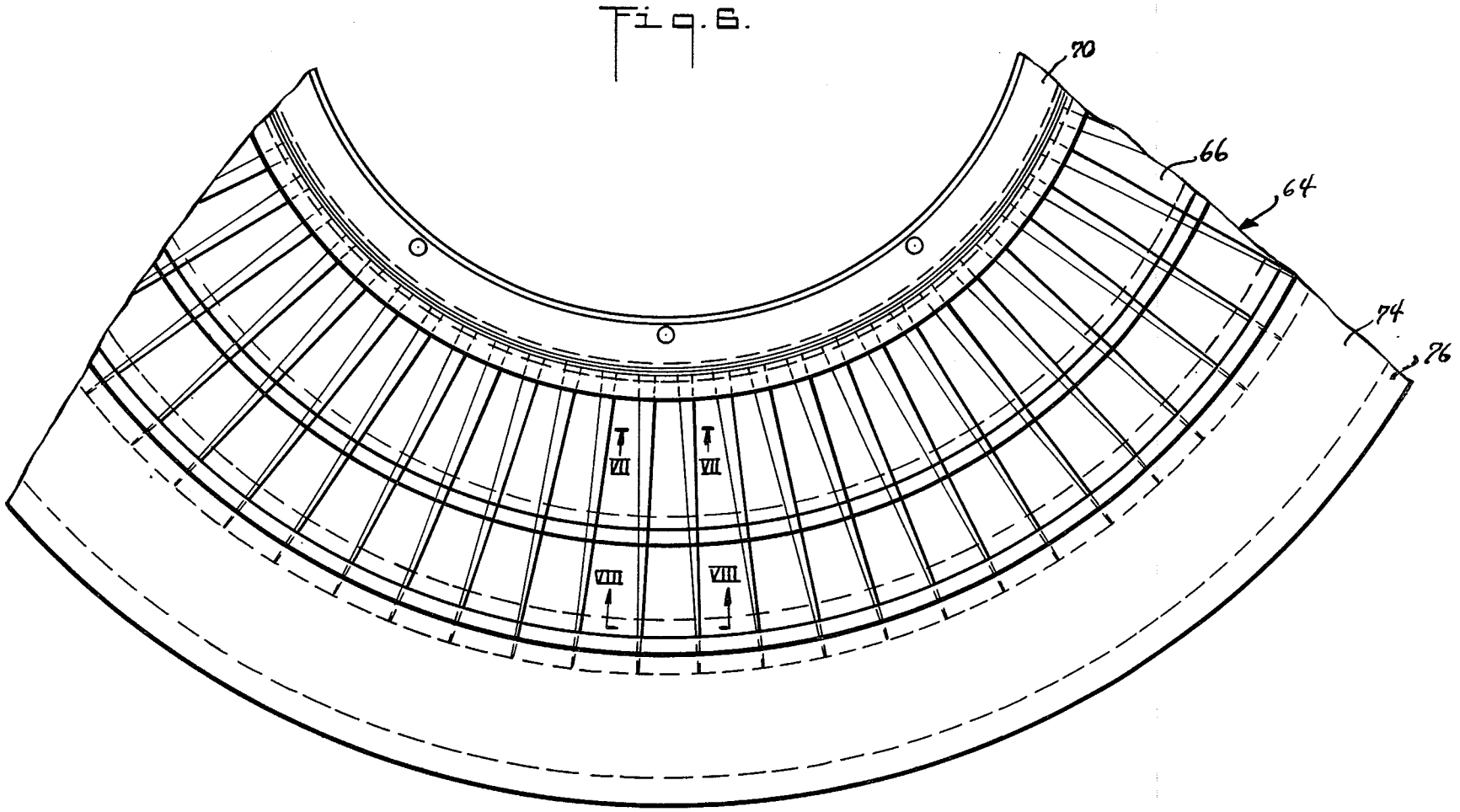
FIG. 6 is a detail of an end view of the helix of FIG. 4.

The helix 60 embodying this invention is shown in FIGS. 4, 5, and 6. The helix comprises a tube 62 to which is welded a fin assembly 64. The fin assembly comprises a central corrugation 66 formed from a rectangular strip of sheet stock, which provides an integral continuous assembly of a folded plate structure spiralling around the tube 62. The corrugation is fastened, as by spot welding, to and between two spiral rings 67, 70 having an almost L-shaped angle cross-section whose individual angle is the supplement of the base angle of the fin and which rings spiral around the tube 62. The rings jointly provide a channel, and are respectively fastened, as by spot welding, to the tube 62. Two flat spiral rings or anulii 72, 74 are fastened, as by spot welding to and astride the distal end of the corrugation, and spiral around the tube 62 coextensively with the corrugation. The rings at their distal ends are respectively fastened, as by spot welding, to a thickness-make-up strip 76 and to each other. These rings serve as guide surfaces for the cylindrical portion of the cases of the rounds. Two additional spiral rings 78, 80 are respectively fastened, as by spot welding, to the corrugation. These rings serve as guide surfaces for the neck portions of the cases. Two more spiral rings 82, 84 are respectively fastened, as by spot welding, to the corrugation. These rings serve as guide surfaces for the ogive portions of the projectiles of the rounds. These four guide rings also spiral around the tube coextensively with the corrugation.

THE SECOND EMBODIMENT

Alternatively, as shown in FIG. 9, the corrugation 66 may be made full radius, and the rings 72, 74 and the strip 76 may be omitted. A U-shaped spiral strip 77 may then be secured, as by spot welding, to and around the distal edge of the corrugation to provide a smooth guide for the cases of the rounds.

In manufacture, the tube 62 is rolled up and seamed from a flat rectangle. The corrugation is formed into a helix from a continuous strip by means of a progressive die stamping operation, one 360° of convolution being formed at a step. The other rings and guides are rolled from respective continuous strips into the desired cross-sections and helical configuration. After the tube 62 is seamed, the channel forming rings 68, 70 are progressively fastened to the tube in respective interlayered helixes. The corrugation, which is quite flexible, is brought over the tube, and then is progressively brought between the rings 67, 70 and fastened thereto. The rings 72, 74 and strip 76 are then threaded along the corrugation and then progressively fastened thereto. The rings 78, 80, 82, 84 are respectively then threaded along the corrugation and then progressively fastened thereto.

It will be appreciated that the integral folded plate structure carries loads in the plane of each thin plate to provide a structure which is very stiff relative to the radius of the helix and the thickness of the plates. Local bending effects and associated peak stresses are minimized. Frictional or circumferential loads are carried by shear action in the thin plates. The transverse component of shear at the inner radius of the sloping web plates is carried to the rings 67, 70 by bearing on the lips of the rings. Axial loads are carried by beam action through the folded plate structure to the rings 67, 70. Each of the helical structures is continuous and integral and avoids discontinuities and stress concentrations. The use of continuous strip stock avoids the generation of scrap material.

In an exemplary two-layered helix of 13 turns, for 30mm rounds, a helix embodying this invention required a fin material thickness of 33% and provided a weight of 60% of a conventional helix of equivalent load carrying ability.

The term "folded plate structure" has been defined in the specification above, and is also a conventional term of art as shown, for example in "Design of Light Gage Cold-Formed Steel Structures" by Wei-Wen Yu, published by Engineering Experiment Station, West Virginia University, 1965; pages 78–81 being of particular interest.

The folded plate structure wherein each plate is bent with a substantially sharp fold from the next adjacent plate, provides a fin or web which is very efficient in supporting a load with minimal deflection, distortion, or buckling. It accomplishes this both by transmitting loads along its flat plates and by having a relatively high moment of inertia. By comparison, a round-bend corrugated structure bulges under load, and has a relatively lower moment of inertia.

What is claimed is:

1. An article handling system for rounds of ammunition each having a necked case and a projectile comprising:

an outer drum having a plurality of mutually spaced apart, centripetally directed, longitudinally extending guides, mutually adjacent guides defining respective channels for receiving longitudinally extending rows of rounds;

an inner shaft means having a helical fin comprising an integrally continuous folded plate structure spiraling around said shaft means in a plurality of turns;

channel means spiraling around said shaft means in a plurality of turns coextensively with said fin and fastened to and between said shaft means and said fin;

a frist additional pair of respectively integrally continuous guide rings, one on each side of said fin, each respectively spiraling around said shaft means in a plurality of turns coextensive with said fin and fastened thereto at a radial distance whereat each said first guide ring bears against the neck of the case of each round.

2. A system according to claim 1 further including:

a second additional pair of respectively integrally continuous guide rings, one on each side of said fin, each respectively spiraling around said shaft means in a plurality of turns coextensive with said fin and fastened thereto at a radial distance whereat each said second guide ring bears against the ogive of the projectile of each round.

3. A helical assembly comprising:

a cylinder;

a helical fin comprising an integrally continuous folded plate structure having a repeated cycle of four flat, substantially triangular plates, two extending substantially transversely and two extending substantially longitudinally, each plate bent with a substantially sharp fold from the next adjacent plate, spiraling around said cylinder in a plurality of turns and fastened to said cylinder;

a first continuous strip spiraling around said cylinder in a plurality of turns coextensive with said folded plate structure and abuting a first of said transversely extending plates in each cycle along an area intermediate the cylinder-distal and cylinder-proximal ends of said first plate.

4. An assembly according to claim 3 further comprising:

a second continuous strip spiraling around said cylinder in a plurality of turns coextensive with said folded plate structure and abuting the second of said transversely extending plates in each cycle along an area intermediate the cylinder-distal and cylinder-proximal ends of said second plate.

5. An assembly according to claim 4 wherein:

said first and second strips are fixed to said first and second plates respectively.

6. A helix assembly comprising:

an inner shaft means, a helical fin comprising a continuous folded plate structure spiraling around said shaft means in a plurality of turns, channel means spiraling around said shaft means in a like plurality of turns coextensively with said fin and fastened to and between said shaft means and said fin, said fin having a shaft means-distal helical edge and a shaft means-proximal helical edge;

a first continuous guide ring, on one side of said fin, spiraling around said shaft means in a like plurality of turns coextensive with said fin and fastened thereto at a first radial distance between said shaft means distal and proximal fin edges.

7. A helix assembly according to claim 6 further comprising:

a second continuous guide ring, on the other side of said fin from said first ring, spiraling around said shaft means in a like plurality of turns coextensive with said fin and fastened thereto at a second radial distance between said shaft means distal and proximal fin edges.

8. A helix assembly according to claim 7 wherein:

said first and second radial distances are substantially equal.

9. A helix assembly according to claim 8 further including:

an additional pair of respectively continuous guide rings, one on each side of said fin, each respectively spiraling around said shaft means in a like plurality of turns coextensive with said fin and fastened thereto at a third radial distance between said shaft means distal and proximal fin edges.

10. A helix assembly for rounds of ammunition each having a necked case and a projectile comprising:

an inner shaft means, a helical fin comprising a continuous folded plate structure spiraling around said shaft means in a plurality of turns, channel means spiraling around said shaft means in a like plurality of turns coextensively with said fin and fastened to and between said shaft means and said fin, said fin having a shaft means-distal helical edge and a shaft means-proximal helical edge;

a first continuous guide ring, on one side of said fin, spiraling around said shaft means in a like plurality of turns coextensive with said fin and fastened thereto at a first radial distance between said shaft means distal and proximal fin edges;

a second continuous guide ring, on the other side of said fin from said first ring, spiraling around said shaft means in a like plurality of turns coextensive with said fin and fastened thereto at a second radial distance between said shaft means distal and proximal fin edges;

said first and second radial distances being substantially equal;

said first and second guide rings for bearing against the neck of the case of each round.

11. A helix assembly for rounds of ammunition each having a necked case and a projectile comprising:

an inner shaft means, a helical fin comprising a continuous folded plate structure spiraling around said shaft means in a plurality of turns, channel means spiraling around said shaft means in a like plurality of turns coextensively with said fin and fastened to and between said shaft means and said fin, said fin having a shaft means-distal helical edge and a shaft means-proximal helical edge;

a first continuous guide ring, on one side of said fin, spiraling around said shaft means in a like plurality of turns coextensive with said fin and fastened thereto at a first radial distance between said shaft means distal and proximal fin edges;

a second continuous guide ring, on the other side of said fin from said first ring, spiraling around said shaft means in a like plurality of turns coextensive with said fin and fastened thereto at a second radial distance between said shaft means distal and proximal fin edges;

said first and second radial distances being substantially equal;

an additional pair of respectively continuous guide rings, one on each side of said fin, each respectively spiraling around said shaft means in a like plurality of turns coextensive with said fin and fastened thereto at a third radial distance between said shaft means distal and proximal fin edges;

each of said additional guide rings for bearing against the ogive of the projectile of each round.

12. An article handling system comprising:

an outer drum having a plurality of mutually spaced apart, centripetally directed, longitudinally extending guides, mutually adjacent guides defining respective channels for receiving longitudinally extending rows of articles; and an inner shaft means having a cylinder, a helical fin comprising an integrally continuous folded plate structure having a repeated cycle of four flat, substantially triangular plates, two extending substantially transversely and two extending substantially longitudinally, each plate bent with a substantially sharp fold from the next adjacent plate, spiraling around said cylinder in a plurality of turns and fastened to said cylinder, a first continuous strip spiraling around said cylinder in a like plurality of turns coextensive with said folded plate structure and abutting a first of said transversely extending plates in each cycle along an area intermediate the cylinder-distal and cylinder-proximal ends of said first plate.

13. A system according to claim 12 further comprising:

a second continuous strip spiraling around said cylinder in a like plurality of turns coextensive with said folded plate structure and abutting the second of said transversely extending plates in each cycle along an area in each cycle along an area intermediate the cylinder-distal and cylinder-proximal ends of said second plate.

14. A system according to claim 13 further comprising:

a third continuous strip spiraling around said cylinder in a like plurality of turns coextensive with said folded plate structure, at a uniform spacing from said first strip, and abutting said first of said transversely extending plates in each cycle along an area intermediate the cylinder-distal and cylinder-proximal ends of said first plate.

15. A system according to claim 14 further comprising:

a fourth continuous strip spiraling around said cylinder in a like plurality of turns coextensive with said folded plate structure, at a uniform spacing from said second strip, and abutting said second of said transversely extending plates in each cycle along an area intermediate the cylinder-distal and cylinder-proximal ends of said second plate.

16. An article handling system for articles having an upper portion of a first diameter and a lower portion of a second diameter comprising:

an outer drum having a plurality of mutually spaced apart, centripetally directed, longitudinally extending guides, mutually adjacent guides defining respective channels for receiving longitudinally extending rows of articles; and an inner shaft means having a cylinder;

a helical fin comprising an integrally continuous folded plate structure having a repeated cycle of four flat, substantially triangular plates, two extending substantially transversely and two extending substantially longitudinally, each plate bent with a substantially sharp fold from the next adjacent plate, spiraling around said cylinder in a plurality of turns and fastened to said cylinder;

a first continuous strip spiraling around said cylinder in a like plurality of turns coextensive with said folded plate structure and abutting a first of said transversely extending plates in each cycle along an area intermediate the cylinder-distal and cylinder-proximal ends of said first plate;

a second continuous strip spiraling around said cylinder in a like plurality of turns coextensive with said folded plate structure and abutting the second of said transversely extending plates in each cycle along an area in each cycle along an area intermediate the cylinder-distal and cylinder-proximal ends of said second plate;

a third continuous strip spiraling around said cylinder in a like plurality of turns coextensive with said folded plate structure, at a uniform spacing from said first strip, and abutting said first of said transversely extending plates in each cycle along an area intermediate the cylinder-distal and cylinder-proximal ends of said first plate;

a fourth continuous strip spiraling around said cylinder in a like plurality of turns coextensive with said folded plate structure, at a uniform spacing from said second strip, and abutting said second of said transversely extending plates in each cycle along an area intermediate the cylinder-distal and cylinder-proximal ends of said second plate;

said first and second strips for bearing against the upper portion of each article, and said second and fourth strips for bearing against the lower portion of each article.

* * * * *